US011655750B2

(12) United States Patent
Casale et al.

(10) Patent No.: US 11,655,750 B2
(45) Date of Patent: May 23, 2023

(54) VEHICLE ENGINE FLUSHING MACHINE WITH HEATING AND REVERSE FLOW

(71) Applicant: Norco Industries, Inc., Compton, CA (US)

(72) Inventors: Frank Casale, Compton, CA (US); Dave Werthmann, Compton, CA (US); Jeff Romero, Compton, CA (US)

(73) Assignee: Norco Industries, Inc., Compton, CA (US)

( * ) Notice: Subject to any disclaimer, the term of this patent is extended or adjusted under 35 U.S.C. 154(b) by 0 days.

(21) Appl. No.: 17/468,570

(22) Filed: Sep. 7, 2021

(65) Prior Publication Data

US 2022/0074340 A1 Mar. 10, 2022

Related U.S. Application Data

(60) Provisional application No. 62/706,750, filed on Sep. 8, 2020.

(51) Int. Cl.
*F01P 11/06* (2006.01)

(52) U.S. Cl.
CPC ..... *F01P 11/06* (2013.01); *F01P 2011/063* (2013.01); *F01P 2011/065* (2013.01); *F01P 2025/08* (2013.01)

(58) Field of Classification Search
CPC ..... F01P 11/06; F01P 11/12; F01P 2011/063; F01P 2025/00; F01P 2011/065
See application file for complete search history.

(56) References Cited

U.S. PATENT DOCUMENTS

| | | | | |
|---|---|---|---|---|
| 4,694,784 | A * | 9/1987 | Hirano | F01P 11/18 123/41.27 |
| 6,179,018 | B1 * | 1/2001 | Erwin | F16H 57/0408 141/98 |
| 6,782,926 | B1 * | 8/2004 | Hughes | F01P 11/18 141/59 |
| 11,111,128 | B2 * | 9/2021 | Van Wyk | B67D 7/82 |
| 2001/0047907 | A1 * | 12/2001 | Viken | F16H 57/0408 184/1.5 |
| 2009/0013670 | A1 * | 1/2009 | Cooke | F01N 3/2066 222/61 |
| 2010/0025341 | A1 * | 2/2010 | Priest | B01D 1/14 210/98 |
| 2010/0230347 | A1 * | 9/2010 | Haslem | B01D 17/0208 210/523 |

(Continued)

*Primary Examiner* — Long T Tran
(74) *Attorney, Agent, or Firm* — Fulwider Patton LLP

(57) ABSTRACT

A fluid flushing machine for a vehicle engine component uses a pre-heated cleaner/fluid to increase the effectiveness of the cleaning procedure and reduce the time needed to clean the component. The invention is designed to clean air charged coolers, EGR valves, EGR coolers, and other components that over time have become contaminated with carbon build up, oil, and debris. The machine of the present invention has the option to direct heated cleaning fluid through the vehicle engine's cooling system to remove carbon build up, oil, and debris in the vehicle's EGR valve and cooler component. The machine of the present invention is adapted to perform the operation in an engine-off condition by incorporating an integrated or external electronic device to open the vehicle's EGR valve to allow the cleaning fluid to flow through the engine while it is turned off.

7 Claims, 3 Drawing Sheets

(56) References Cited

U.S. PATENT DOCUMENTS

| | | | | |
|---|---|---|---|---|
| 2011/0308740 | A1* | 12/2011 | Priest | C10M 175/0058<br>159/16.1 |
| 2016/0051916 | A1* | 2/2016 | Lauer | F02M 37/44<br>210/99 |
| 2019/0136727 | A1* | 5/2019 | Lamb | F16H 57/045 |

* cited by examiner

VEHICLE ENGINE FLUSHING MACHINE WITH HEATING AND REVERSE FLOW

CROSS-REFERENCES TO RELATED APPLICATIONS

This application claims priority from U.S. Provisional Patent Application No. 62/706,750, filed Sep. 8, 2020, the content of which is incorporated by reference herein in its entirety.

BACKGROUND OF THE INVENTION

The present invention relates to a vehicle engine component flushing machine, and more particularly to an engine component flushing machine that heats and circulates high volumes of cleaning fluid to efficiently flush carbon fouled engine components.

A vehicle's exhaust gas recirculation system is a vital subsystem of the vehicle engine's performance. Maintenance of a vehicle's engine can require periodic cleaning of various engine components due to normal use contamination that can compromise the performance of their respective functions. Contamination often occurs in the form of carbon deposits and other combustion byproducts on internal surfaces exposed to hot combustion gasses. Vehicle engine component flushing machines are well known in the art. Typically a cleaning fluid is pumped into the engine component being cleaned and extracted at the end of the component's path, where pollutants and combustion debris are removed and then replaced with fresh fluids. Depending upon the amount of buildup on the engine component being cleaned, the flushing process can take several hours to complete. If this process could be sped up, more vehicles could be serviced and the service operator can increase his profits. One option is to use a stronger cleaning agent, but seals and other components can be damaged by chemicals that are too harsh. A better solution to the problem is needed to reduce the amount of time to conduct a complete fluid flushing operation while protecting the internal components from undue stress and wear.

SUMMARY OF THE INVENTION

The present invention is a fluid flushing machine for a vehicle engine component that uses a pre-heated cleaner/fluid to increase the effectiveness of the cleaning procedure and reduce the time needed to clean the component. The invention is designed to clean air charged coolers, EGR valves, EGR coolers, and other components that over time have become contaminated with carbon build up, oil, and debris. The machine of the present invention has the option to introduce heated cleaning fluid through the vehicle engine's cooling system, which can be pumped in either direction, to expel carbon build up, oil, and debris in the vehicle's EGR valve and cooler component. The machine of the present invention is adapted to perform the operation in an engine-off condition by incorporating an integrated or external electronic device to open the vehicle's EGR valve to allow the cleaning fluid to flow through the engine while it is turned off.

With the EGR valve forced open by the valve actuator and the engine off, the engine component's internal passages are flushed out with cleaning fluid through the dedicated pathways in the forward and reverse directions. The machine uses fluid couplings to introduce and remove fluid at both the inlet and outlet ports of the vehicle's cooler. The fluid exchange machine includes a fluid heating device to optionally heat the cleaning fluid prior to its introduction into the engine component being cleaned, and a three way valve is provided to allow for circulation of the cleaning fluid during the initial heating phase that permits flow back to the holding tank rather than through the component being cleaned. The cleaning fluid may be heated to a temperature of approximately 120+ degrees F.

In one preferred embodiment of the present invention, sensors are provided that can determine a level of contamination in the hot cleaning fluid returned to the holding tank. Contamination from the component being cleaned collects in the holding tank and accumulates over time. The service can be said to be complete when no perceptible or meaningful level of contamination is being added to the holding tank from the cleaning action of the hot cleaning solution acting on the components surfaces. The sensors can be of the type that measure resistance between one or more pairs of probes mounted to the tank wall at a level that is below the surface of the cleaning solution. By comparing the conductivity (or other solution characteristics) of the solution over time, a predictive algorithm stored in the controller alerts the user when the incremental contamination has essentially reached a steady state, indicating that the component being flushed has been cleaned and no new contamination is being added to the tank. This saves time in flushing operations by reducing the amount of time required for the repair.

A housing stores a tank that supplies clean, fresh cleaning fluid for the flushing operation and receives the spent cleaning fluid with the contaminants removed from the engine component being cleaned. The fluid exchange machine can alternate between heated and unheated flushing via a switch, and for the heated flow the fluid may be circulated through the machine while the heating element heats the fluid to reach the desired temperature. Once the elevated temperature is reached, the three way valve redirects the heated fluid into the engine component and is filtered and reheated and recirculated until the cleaning operation is complete. A temperature sensor in the fluid tank measures the fluid's temperature and sends a signal to the processor to illuminate a light on the control panel when the fluid has reached its optimal temperature indicating to the operator that the machine is ready to perform the service. In a preferred embodiment, special adapters are provided that allow for direct connection to the EGR valve without removing the EGR component from the vehicle.

After the service, the fluid tank is drained using the onboard fluid pump, or drained manually from a port on the bottom of the fluid tank. The machine preferably includes a fluid level sensor in the fluid tank that can send a signal to the processor when the fluid level falls below a level necessary to complete the procedure or where the heating element is not fully submerged, whereupon the processor illuminates a low fluid level light on the control panel to alert the operator of the fluid level condition. Operating the heating element without sufficient fluid can damage the heating element or other elements of the machine. In a preferred embodiment, should the fluid level fall below a minimum amount, the processor automatically shuts off the heater, which is temperature controlled by a thermostat.

These and other advantages of the present invention will best be understood with reference to the Figures and the detailed description of the invention below.

DETAILED DESCRIPTION OF THE PREFERRED EMBODIMENTS

Figure 1:
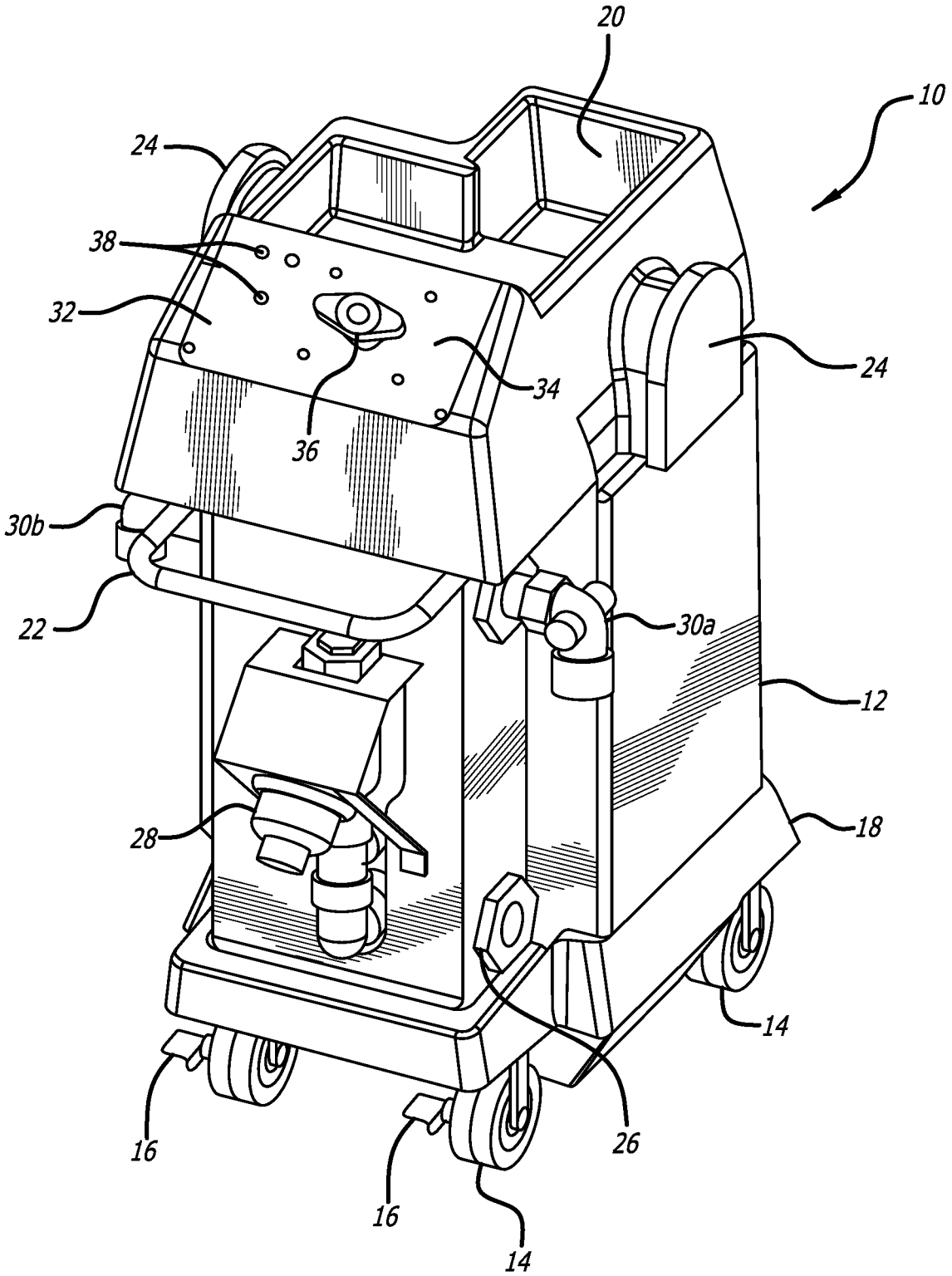
FIG. 1 is an elevated, perspective view of a first preferred embodiment of the present invention.

FIG. 1 illustrates an exemplary embodiment of a vehicle engine component flushing machine 10 for cleaning EGR valves of the present invention. The fluid exchange machine 10 introduces, recirculates, and drains coolers and various engine components to remove oil, debris, deposits and products of combustion. The machine 10 is formed of a sturdy housing 12 supported on four wheels 14 that allow the machine 10 to be moved to a vehicle to be serviced for the flushing operation, and each wheel 14 can be supplied with a releasable brake 16 to prevent the machine from moving once in place. The wheels 14 are mounted to a skirt 18 that supports the housing 12 and protects the machine from damage or marring. The housing 12 may be formed with a well 20 on the upper surface to hold hoses, adapters, extra fluid, etc. A handle 22 is provided to tow or push the machine 10 to the location of the service as well as store the hoses for the fluid exchange operation. Rounded spools 24 are positioned on each side of the machine to store power cords. The housing 12 includes a drain port 26 for passively/gravitationally draining the used fluid tank in case of a pump failure or lack of available power, and a pipe 28 protrudes from the housing that is connected to the internal pump that can be used to actively pump out the used fluid to a waste fluid bin after the service is completed. A fluid outlet elbow 30*a* with flange and a fluid inlet elbow 30*b* with flange are provided on either side of the housing 12 to provide a fluid path into and out of the machine. The elbows are connected to hoses (not shown) to provide a path for fluid to enter and exit the vehicle. On the upper front surface 32 is a control panel 34 that includes buttons with tactile sense feedback 36 to initiate, terminate, and set the type of flushing operation (heated or not heated). The control panel 34 also includes various warning lights and indicator lights 38 providing feedback to the operator on status of the machine 10 and the fluid flushing operation.

The fluid flushing machine 10 may be connected to the vehicle's heat exchanger component (or other vehicle component to be flushed) without removing the component from the vehicle itself. Hoses connect at an inlet port and an outlet port of the heat exchanger or other vehicle component to be cleaned, and cleaning fluid is then introduced into the component to flush out debris and remove deposits collected on the interior conduits and pathways within the heat exchanger component. The present invention supplies preheated cleaning fluid that can be pumped in either direction to more efficiently clean the component being cleaned.

Figure 2:
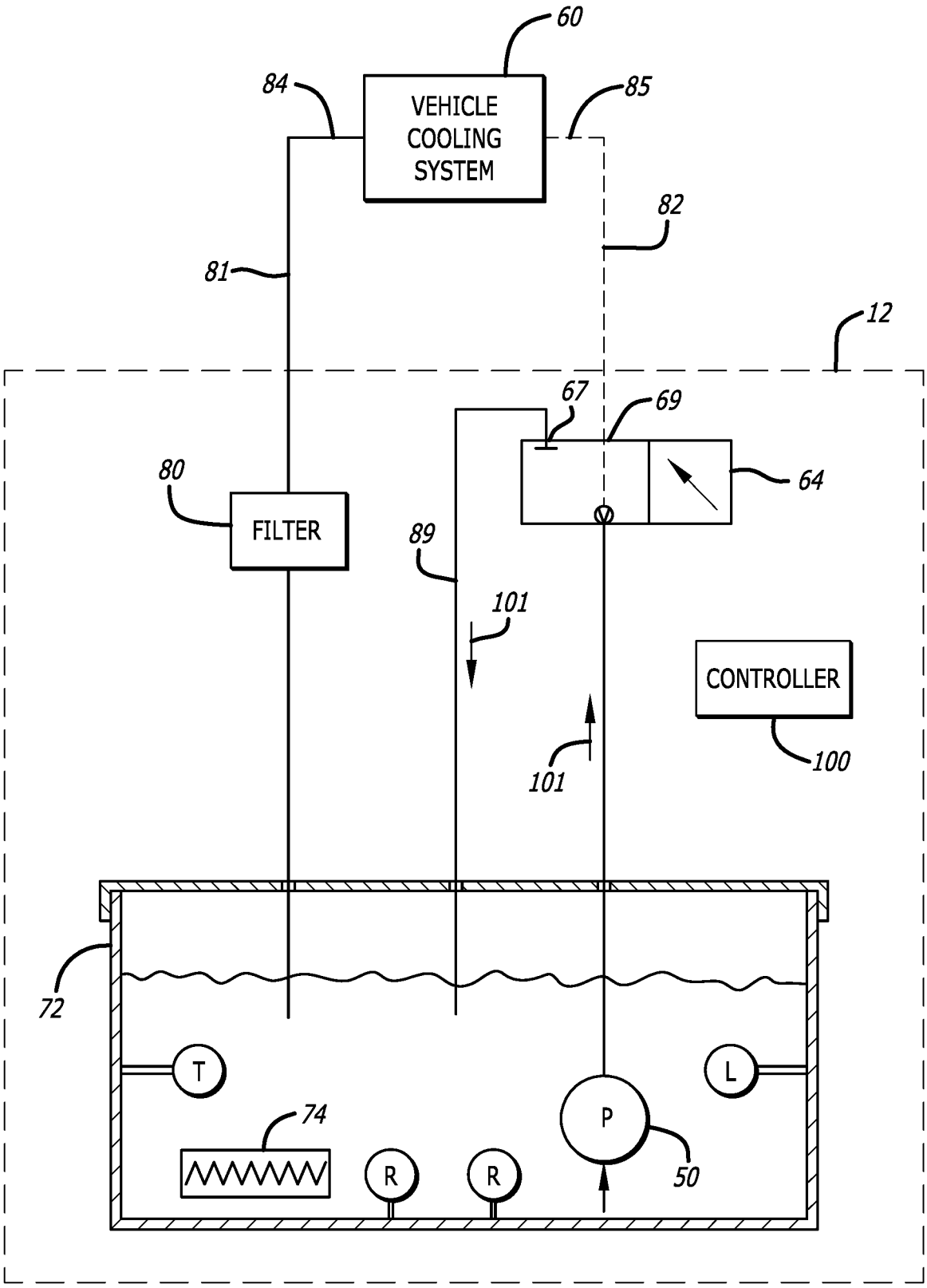
FIG. 2 is a schematic diagram of the components of the embodiment of FIG. 1 showing a first configuration with recirculating fluid prior to introduction into a vehicle.

FIG. 2 illustrates a schematic of the components of the present invention that perform the fluid flushing operation. A pump 50 within the housing 12 is submerged in a tank 72 of cleaning fluid and can pump the fluid out of the tank 72 and into a three way valve 64, such as a ball valve. Before the fluid is heated to its effective temperature, the fluid exits the three way valve 64 at first exit 67 and through conduit 89 so as to be redirected back into the fluid tank 72 for further heating. The tank 72 also includes a heating element 74 that can heat the cleaning fluid to a temperature of 120° F. or more. A temperature sensor T measures the temperature of the fluid in the tank as shown by the arrows 101, and relays the temperature to the controller 100 while the three way valve 64 redirects the fluid back into the tank 72 via conduit 89, recirculating the fluid until it is ready to be introduced into the vehicle's component 60 being cleaned. A tank fluid level sensor L monitors the level of fluid in tank 72 of cleaning fluid and communicates with the controller 100 to send an alarm to the control panel 34 if the fluid falls below a level needed to perform a proper flushing operation or falls below the height of the heating element 74. The level sensor L prevents damage to the heating element 74 and pump 50 by ensuring that there is sufficient fluid in the tank 72 to immerse the heating element and pump.

A pair of resistive probes R are used to measure the resistance between the two probes for the purpose of evaluating the level of contamination in the fluid. The controller 100 is equipped with an algorithm that can determine a level of contamination based on the resistance measured between the probes. As the contaminants are removed from the vehicle's component and accumulated in the tank 72, the amount of contaminants will eventually reach a steady state, indicating that further recirculation will not remove additional contaminants. This allows the user via a signal on the control panel to stop the operation as the cleaning operation is then complete.

The fluid levels, temperatures, and pressures are all recorded by the controller 100, which can manage the heating element 74 and pump 50 to properly carry out the cleaning operation. The control panel 34 shows the indicator lights for fluid level, status, temperature, and other conditions including controls for managing the temperature, direction, and duration of the fluid flow through the component being cleaned.

Figure 3:
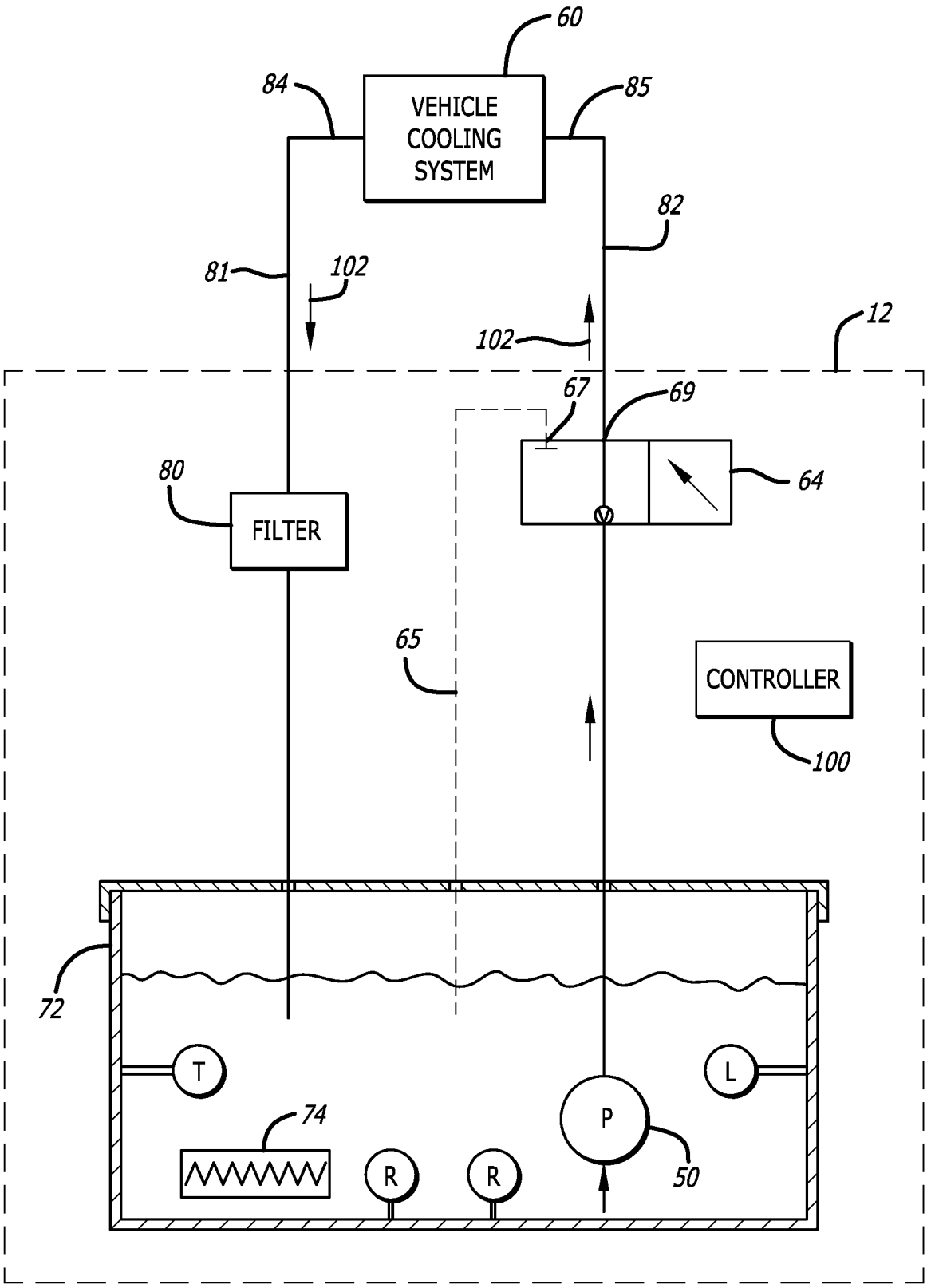
FIG. 3 is a schematic diagram of the components of the embodiment of FIG. 1 showing a second configuration with fluid flow into and out of the vehicle to be serviced.

FIG. 3 shows a second configuration where the fluid has reached the desired temperature as determined by the temperature sensor T in the tank 72 and the three way valve 64 is switched to direct the fluid into the vehicle's cooling system 60. Here, fluid exits the three way valve 64 at second outlet 69 and flows via conduit 82 directly into the inlet 85 of the cooling system 60, through the cooling system, and exits outlet 84, and is then directed via conduit 81 through filter 80 and back into the tank 72 as indicated by arrows 102. The flow can be circulated through this flow path without heating if the heating element is selectively turned off. The ability to change directions of the fluid flow through the engine's cooling system by reversing hoses 81 and 82 with inlet 85 and outlet 84 permits another mode of agitation and turbulence in the engine cooling system to enhance the cleaning effectively and shorten the time needed to completely clean the engine's component.

While certain preferred embodiments have been described and depicted herein and in the drawings, it is understood that the invention is not limited to those depictions and descriptions unless specifically so expressed. Rather, a person of ordinary skill in the art will readily appreciate certain modifications, substitutions, and variations and the invention is intended to include all such modifications, substitutions, and variations. Accordingly, the scope of the claims are properly determined by the appended claims using their customary and ordinary meanings, consistent with but not limited by the descriptions and depictions herein.

We claim:

1. A fluid exchange machine for introducing cleaning fluid into a vehicle engine's component while the vehicle engine is off, comprising:

a housing;

a controller in the housing;

a fluid system having a fluid tank, a pump disposed in the fluid tank, and fluid heating element disposed in the fluid tank; and a three way valve connecting the pump, the fluid tank, and a vehicle engine's cooling system; and wherein the fluid system includes a first path from the pump through the three way valve and back to the fluid tank, and a second path from the pump to the three way valve to the vehicle engine's component and then back to the fluid tank; and wherein the fluid exchange machine operates using the first path while a fluid temperature is below a designated temperature, and operates using the second path when the fluid temperature is at or above the designated temperature.

2. The fluid exchange machine of claim 1, wherein the pump is submerged in the fluid, and the system further comprises a level sensor to trigger an alarm if the fluid falls below a designated level.

3. The fluid exchange machine of claim 2, wherein the fluid exchange machine includes sensors for determining a resistance of said fluid.

4. The fluid exchange machine of claim 1, further comprising a temperature sensor and the fluid exchange machine is configured to control the temperature of the fluid flowing through the vehicle engine's component.

5. The fluid exchange machine of claim 1, further comprising an outlet for expelling used cleaning fluid.

6. The fluid exchange machine of claim 5, wherein the pump is used to expel the used cleaning fluid.

7. The fluid exchange machine of claim 5, wherein the used cleaning fluid is expelled gravitationally through an outlet port.

* * * * *